US008125159B2

(12) United States Patent
Aiello

(10) Patent No.: US 8,125,159 B2
(45) **Date of Patent: *Feb. 28, 2012**

(54) LED DRIVING DEVICE WITH VARIABLE LIGHT INTENSITY

(75) Inventor: Natale Aiello, Trecastagni (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

This patent is subject to a terminal disclaimer.

(21) Appl. No.: 12/773,724

(22) Filed: May 4, 2010

(65) Prior Publication Data

US 2010/0213845 A1 Aug. 26, 2010

Related U.S. Application Data

(63) Continuation of application No. 11/153,848, filed on Jun. 14, 2005, now Pat. No. 7,750,579.

(30) Foreign Application Priority Data

Jun. 14, 2004 (EP) ..... 04425437

(51) Int. Cl.
*H05B 41/16* (2006.01)

(52) U.S. Cl. ..... 315/274; 315/247; 315/291; 315/307; 315/312

(58) Field of Classification Search ..... 315/247, 315/246, 224, 225, 185 S, 291, 297, 307–326
See application file for complete search history.

(56) References Cited

U.S. PATENT DOCUMENTS

| | | | | |
|---|---|---|---|---|
| 5,887,967 | A | 3/1999 | Chang | |
| 6,040,663 | A | 3/2000 | Bucks et al. | |
| 6,227,679 | B1 | 5/2001 | Zhang et al. | |
| 6,456,051 | B2 | 9/2002 | Darzy | |
| 6,747,420 | B2 | 6/2004 | Barth et al. | |
| 7,298,350 | B2 | 11/2007 | Kitazawa et al. | |
| 7,511,436 | B2 | 3/2009 | Xu | |
| 2001/0024112 | A1 | 9/2001 | Jacobs et al. | |
| 2002/0043943 | A1 | 4/2002 | Menzer et al. | |
| 2003/0085749 | A1 | 5/2003 | Xu et al. | |
| 2003/0117087 | A1 | 6/2003 | Barth et al. | |
| 2010/0141162 | A1 * | 6/2010 | Matsumoto et al. | 315/186 |

OTHER PUBLICATIONS

European Search Report Dated Nov. 16, 2004, for European Patent Application No. EP04425437 Filed Jun. 14, 2004, 2 Pages.

* cited by examiner

*Primary Examiner* — Tuyet Thi Vo
(74) *Attorney, Agent, or Firm* — Graybeal Jackson LLP

(57) ABSTRACT

In a device for driving LEDs with variable light intensity, a supply stage has a first operating mode, in which a controlled supply current is generated, and a second operating mode, in which a controlled supply voltage is generated. A LED is connected to the supply stage, receives the controlled supply current or voltage, and has a turning-on threshold voltage higher than the controlled supply voltage. A current sensor generates a current-feedback signal that is correlated to the current flowing in the LED and is supplied to the supply stage in the first operating mode. An intensity-control stage generates a mode-control signal that is sent to the supply stage and controls sequential switching between the first and the second operating modes of the supply stage.

21 Claims, 2 Drawing Sheets

LED DRIVING DEVICE WITH VARIABLE LIGHT INTENSITY

PRIORITY CLAIM

The present application is a continuation of U.S. patent application Ser. No. 11/153,848, filed Jun. 14, 2005, which application claims the benefit of European Patent Application No. 04425437.3, filed Jun. 14, 2004; all of the foregoing application are incorporated herein by reference in their entireties.

TECHNICAL FIELD

Embodiments of the present disclosure relate to a LED driving device with variable light intensity.

BACKGROUND

As is known, thanks to the marked development of silicon-based technologies, high-efficiency light-emitting diodes (LEDs) are increasingly used in the field of lighting, whether industrial or domestic lighting. For example, high-efficiency LEDs are commonly used in automotive applications (in particular for the manufacturing the rear lights of motor vehicles), in road signs, or in traffic lights.

According to the light intensity that it is desired to obtain, it is possible to coupled alternately a number of LEDs in series or a number of arrays of LEDs in parallel (by the term array is meant, in this context, a certain number of LEDs coupled in series to one another). Clearly, the number of LEDs and the criterion of connection adopted determine the characteristics of the driving device (hereinafter "driver") that must be used for driving the LEDs.

In particular, with the increase in the number of LEDs coupled in series, the value of the output voltage of the driver must increase, while, with the increase in the number of arrays in parallel, the value of the current that the driver must be able to furnish for supplying the LEDs must increase.

Furthermore, the intensity of current supplied to a LED determines its spectrum of emission and hence the color of the light emitted. It follows that, to prevent the spectrum of emission of a LED from varying, it is of fundamental importance that the supply current should be kept constant, and hence generally the driver used for driving the LEDs is constituted by a current-controlled DC/DC converter.

As is known, the topology of the DC/DC converter differs according to the type of application envisaged. Normally, the configurations "flyback" or "buck" are used, respectively, if an electrical insulation is required or if the driver is supplied directly by the electric power-supply mains (and hence there is no need to step up the input voltage), whereas the "boost" configuration is used when the driver is battery-supplied and it is hence necessary to step up the input voltage.

In many applications, it is required to vary the intensity of the light emitted by the LED gradually, this operation being known by the term "dimming".

On the other hand, it is not possible to simply vary (either decrease or increase) the supply current supplied to the LED, in so far as it is not possible to accept the change of color of the emitted light (typically, constancy in the spectrum of emission is required), color which, as mentioned, depends upon the supply current.

For this reason, currently drivers for LEDs comprise a pulse-width-modulation (PWM) control for turning on and turning off LEDs at low-frequency (100-200 Hz), with a ratio between turning-on time and turning-off time (duty cycle) that is a function of the level of light intensity required.

To achieve turning-on and turning-off of LEDs, a switch is set in series between the output of the DC/DC converter and the LEDs themselves. Said switch, controlled in PWM, enables or disables the supply of the LEDs. In particular, during the ON phase of the PWM control signal, the switch closes, enabling passage of the supply current to the LEDs and hence their turning-on, while during the OFF phase of the PWM control signal the switch is open, interrupting passage of the supply current and hence causing turning-off of the LEDs. Clearly, the frequency of the PWM control signal is such that the human eye, given the stay time of the image on the retina, does not perceive turning-on and turning-off of the LEDs, since it perceives a light emitted in a constant way.

The circuit described, albeit enabling dimming of the LEDs to be obtained, presents, however, certain disadvantages linked to the presence of a switch coupled to the output of the DC/DC converter in series with the load.

In fact, in the majority of applications, high-efficiency LEDs require high supply currents, in the region of various hundreds of mA (typically between 100 mA and 700 mA). Consequently, the switch set in series to the load must be a power switch; moreover, it must have low leakages in conduction in order not to limit the efficiency for driving. On the other hand, the higher the supply current required by the LEDs, the more critical the choice of the power switch, and consequently the higher the cost of the switch and as a whole the cost of construction of the driver.

Embodiments of the present disclosure provide a LED-driving device that is free from the drawbacks described above, and in particular that enables adjustment of the light intensity of the LEDs in a more economical and efficient way.

SUMMARY

According to an embodiment of the present disclosure there is provided a LED driving device and method with variable light intensity.

BRIEF DESCRIPTION OF THE DRAWINGS

For a better understanding of the present disclosure, there is now described a preferred embodiment thereof, which is provided purely by way of non-limiting example and with reference to the attached drawings, wherein.

DETAILED DESCRIPTION

The following discussion is presented to enable a person skilled in the art to make and use the disclosure. Various modifications to the embodiments will be readily apparent to those skilled in the art, and the generic principles herein may be applied to other embodiments and applications without departing from the spirit and scope of the present disclosure. Thus, the present disclosure is not intended to be limited to the embodiments shown, but is to be accorded the widest scope consistent with the principles and features disclosed herein.

The idea underlying embodiments of the present disclosure draws its origin from the consideration that a LED can be considered as a normal diode, with the sole difference that it has a higher threshold voltage $V_f$ (normally around 3 V as against the 0.7 V of a normal diode). It follows that a LED automatically turns off when it is biased with a voltage lower than the threshold voltage $V_f$. In particular, to obtain turning-off of the LEDs, the driving circuit passes from a current control mode to a voltage control mode, which limits the output voltage to a value lower than the threshold voltage of the LEDs. By varying the intervals of time when the two control modes are active, for example via a PWM control, it is possible to vary the light intensity of the LEDs.

Figure 1:
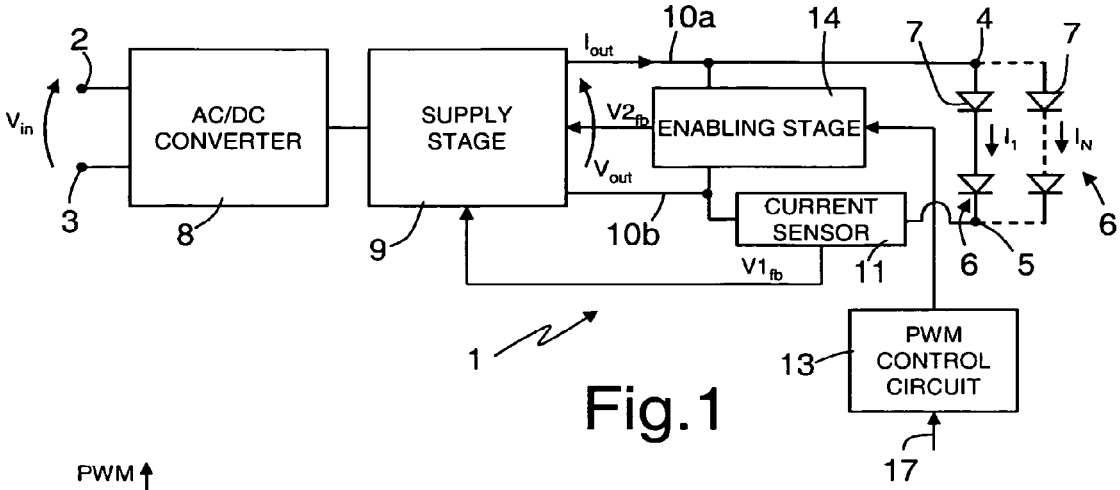
FIG. 1 is a block diagram of a LED driving circuit according to an embodiment of the present disclosure.

For a better understanding of the above, reference is now made to FIG. 1, which illustrates a LED-driving device 1.

In detail, the driving device 1 comprises a pair of input terminals 2, 3, receiving a supply voltage $V_{in}$ (in this case, coming from the electric power-supply mains) and a first and a second output terminals 4, 5, coupled to the load that must be driven. In particular the load is formed by 1 to N arrays 6 of LEDs 7 arranged in parallel, and each array 6 can contain a variable number of LEDs 7 coupled in series to each other.

The driving device 1 moreover comprises an AC/DC converter 8 coupled to the input terminals 2, 3 and operating as a rectifier of the mains voltage, and a supply stage 9, cascade-coupled to the AC/DC converter 8 and supplying an output supply voltage $V_{out}$ and an output supply current $I_{out}$. The supply stage 9 is basically formed by a DC/DC converter and has a first and a second outputs 10*a*, 10*b*, coupled to the first and the second output terminals 4, 5, respectively. A current sensor 11 is coupled between the second output terminal 5 of the driving device 1 and the second output 10*b* of the supply stage 9, and outputs a current-feedback signal $V1_{fb}$ proportional to the current flowing in the load and co-operating with the supply stage 9 for controlling of the current $I_{out}$. Typically, the current sensor 11 comprises a sensing resistor (as described in detail in FIG. 3).

The driving device 1 moreover comprises a PWM control circuit 13, of a known type, and an enabling stage 14. The PWM control circuit 13 receives an external command, indicated schematically by the arrow 17, and generates a PWM control signal, the pulse width whereof is modifiable via the external control circuit 13, in a known way.

The enabling stage 14, controlled by the PWM control signal, is coupled between the first and second outputs 10*a*, 10*b* of the supply stage 9 and outputs a voltage-feedback signal $V2_{fb}$ having two functions: on the one hand, it enables/disables the voltage control of the supply stage 9; on the other, it supplies an information correlated to the voltage $V_{out}$.

To this end, the enabling stage 14 comprises a voltage sensor formed by a resistive divider (as illustrated in detail in FIG. 3), the output signal whereof forms the voltage-feedback signal $V2_{fb}$. In this way, in the voltage-control mode, the supply stage 9 can limit the output voltage $V_{out}$ to a value smaller than the threshold voltage of the arrays 6, equal to the sum of the threshold voltages of the LEDs 7 in each array 6. If the arrays 6 contain a different number of LEDs 7, the output voltage $V_{out}$ is limited to a value smaller than the minimum total threshold value of the arrays 6. For example, if even just one array 6 is made up of a single LED 7, the output voltage $V_{out}$ is limited to a value smaller than the threshold voltage $V_f$ of a LED; for example it can be set at the non-zero value of 2 V.

Operation of the driving device 1 is as follows.

In normal operating conditions, when the voltage control of the supply stage 9 is disabled by the enabling stage 14 (for example, during the OFF phase of the PWM control signal), the supply stage 9 works in a current control mode and uses the current-feedback signal $V1_{fb}$ so that the output current $I_{out}$ has a preset value, such as to forward bias the LEDs 7, which thus conduct and emit light.

In particular, the output current $I_{out}$ has a value equal to the sum of the currents $I_1, \ldots I_N$ that are to be supplied to the various arrays 6 for forward biasing the LEDs 7. The output voltage $V_{out}$ has, instead, a value fixed automatically by the number of driven LEDs 7 (for example, a total threshold voltage value of 35 V, when an array 6 is made up of ten LEDs and each LED has an on-voltage drop of 3.5 V).

In this step, then, the current control enables precise control of the value of the supply current of the LEDs 7 according to the desired spectrum of emission.

When, instead, the voltage control of the supply stage 9 is enabled by the enabling stage 14 (in the example, during the ON phase of the PWM control signal), the value of the voltage $V_{out}$ is limited to a value smaller than the minimum threshold voltage of the arrays 6, so causing turning-off of the LEDs 7, as explained in greater detail with reference to FIG. 3.

The PWM control circuit 13, by varying appropriately the duty cycle of the PWM control signal that controls the enabling stage 14, enables regulation of the intensity of the light emitted by the LEDs 7. In the example, with the increase in the duty cycle, the time interval when the control of the supply stage 9 is a current control and the LEDs 7 are forward biased, increases, and consequently the intensity of the light emitted increases. In particular, a duty cycle equal to zero corresponds to a zero light intensity, while a duty cycle equal to one corresponds to a maximum intensity of the light emitted by the LEDs 7.

Figure 2:
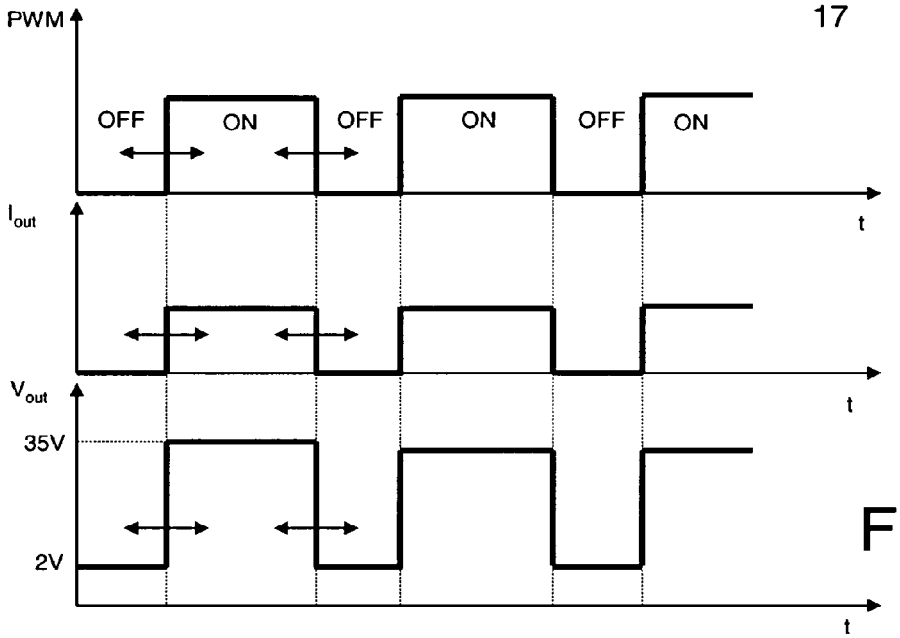
FIG. 2 shows time diagrams of some circuit quantities of the circuit of FIG. 1.

FIG. 2 shows the time plots of the PWM control signal generated by the PWM control circuit 13, of the output current $I_{out}$, and of the output voltage $V_{out}$ during normal operation of the driving device 1.

As may be noted, during the ON phase of the PWM control signal the supply stage 9 works in a current control mode, outputting the current $I_{out}$ for supply of the LEDs 7; the voltage $V_{out}$ assumes a value, for example 35 V. Instead, during the OFF phase of the PWM control signal the supply stage 9 works in a voltage control mode, limiting the output voltage $V_{out}$ to a value, for example 2 V, while the current $I_{out}$ goes to zero.

By appropriately varying the duty cycle of the PWM control signal (as indicated by the arrows in FIG. 2), it is possible to regulate appropriately the level of light intensity of the LEDs 7.

Figure 3:
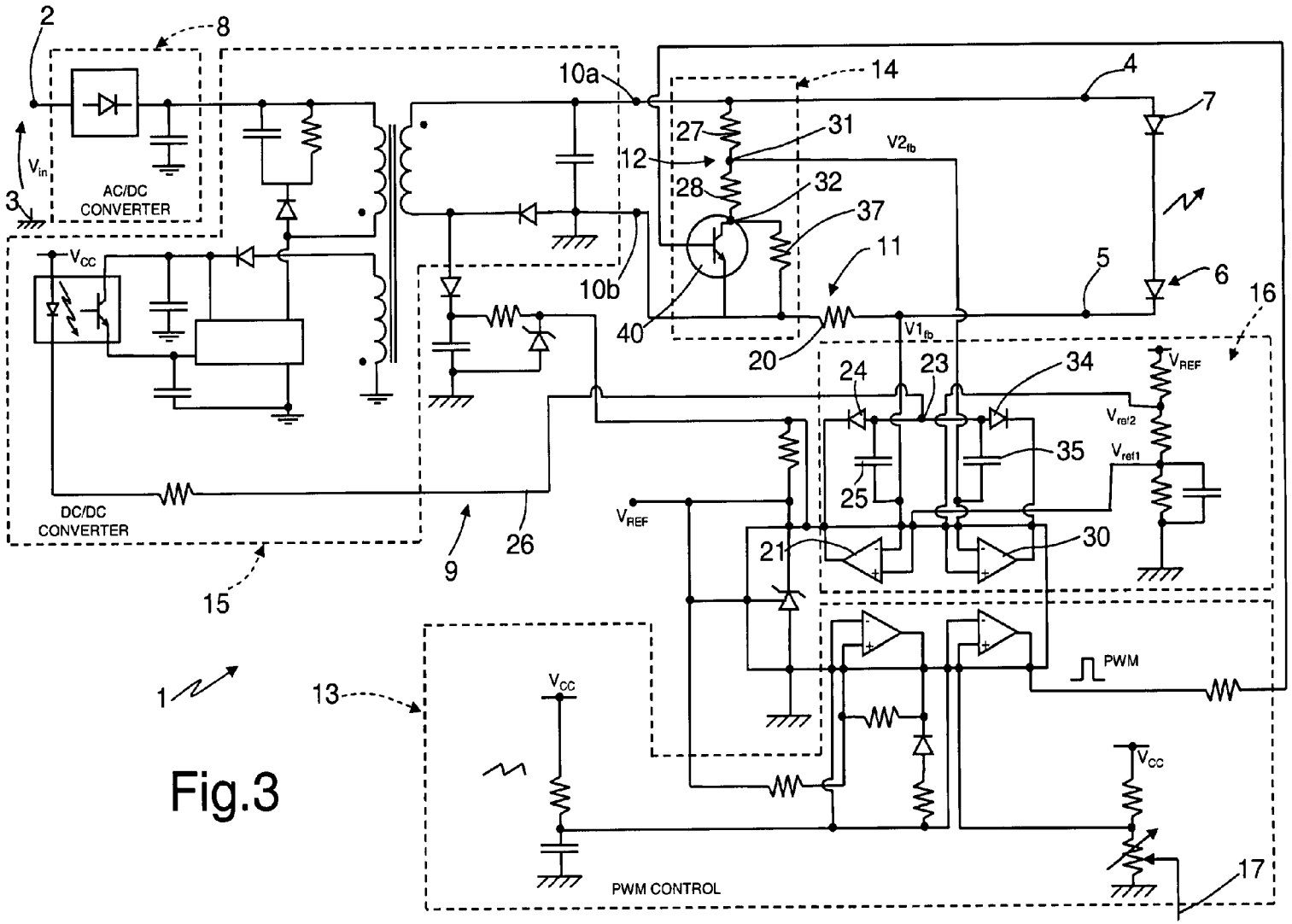
FIG. 3 is a detailed circuit diagram of the driving circuit of FIGS. 1.

FIG. 3 shows a possible circuit embodiment of the driving device 1, when the driving device 1 is supplied by the electrical power mains and a galvanic insulation is moreover required.

In particular, a detailed description of the current sensor 11, the enabling stage 14, and the supply stage 9 is given, since the other components are of a known type.

In detail, the current sensor 11 comprises a sensing resistor 20 coupled between the second output 10*b*, which is grounded, of the supply stage 9 and the second output terminal 5.

The enabling stage 14 comprises a first resistor 27 and a second resistor 28, coupled in series. The first resistor 27 is coupled between the first output terminal 4 and a first intermediate node 31, while the second resistor 28 is coupled between the first intermediate node 31 and a second intermediate node 32. The voltage-feedback signal $V2_{fb}$ is present on the first intermediate node 31. The enabling stage 14 further comprises a third resistor 37 coupled between the second intermediate node 32 and the second output 10*b* of the supply stage 9, and a bipolar transistor 40 of an NPN type, having its collector terminal coupled to the second intermediate node 32, its emitter terminal coupled to the second output 10*b*, and its base terminal receiving the PWM control signal generated in a known way by the PWM control circuit 13. The third resistor 37 forms, together with the first resistor 27 and the second resistor 28, a resistive divider 12, controllable via the PWM control signal.

The supply stage 9 comprises a DC/DC converter 15, of a "flyback" type, cascaded to the AC/DC converter 8 and having the first output 10*a* and the second output 10*b*. The supply stage 9 moreover comprises a selection stage 16 receiving the current-feedback signal $V1_{fb}$ and the voltage-feedback signal $V2_{fb}$, and having an output coupled to a feedback input 26 of the DC/DC converter 15. In particular, the selection stage 16 alternately feeds the feedback input 26 with the voltage-feedback signal $V2_{fb}$ and the current-feedback signal $V1_{fb}$ so as to enable, respectively, voltage control and current control.

In detail, the selection stage 16 comprises a first and a second operational amplifiers 21, 30. The first operational amplifier 21 has its inverting terminal coupled to the second output terminal 5 and receiving the current-feedback signal $V1_{fb}$, its non-inverting terminal receiving a first reference voltage $V_{ref1}$, of preset value, and an output coupled, via the interposition of a first diode 24, to a feedback node 23, which is in turn coupled to the feedback input 26 of the DC/DC converter 15. The first diode 24 has its anode coupled to the output of the first operational amplifier 21 and its cathode coupled to the feedback node 23. Furthermore, a first capacitor 25 is coupled between the inverting terminal of the first operational amplifier 21 and the cathode of the first diode 24. The second operational amplifier 30 has its inverting terminal coupled to the first intermediate node 31 and receiving the voltage-feedback signal $V2_{fb}$, its non-inverting terminal receiving a second reference voltage $V_{ref2}$, of preset value, and an output coupled to the feedback node 23 via a second diode 34. The second diode 34 has its anode coupled to the output of the second operational amplifier 30 and its cathode coupled to the feedback node 23. Furthermore, a second capacitor 35 is coupled between the inverting terminal of the second operational amplifier 30 and the cathode of the second diode 34.

In practice, two distinct feedback paths are formed, which join in the feedback node 23. A first path, which comprises the current sensor 11, enables current control through the current-feedback signal $V1_{fb}$, in so far as it detects the value of the output current $I_{out}$ via the sensing resistor 20. A second path, which comprises the enabling stage 14, enables, instead, voltage control through the voltage-feedback signal $V2_{fb}$, in so far as it detects the value of the output voltage $V_{out}$ via the resistive divider 12.

The two feedback paths are enabled alternately by the enabling stage 14.

In fact, the transistor 40 acts as a switch controlled by the PWM control signal generated by the PWM control circuit 13, determining, with its opening and its closing, two different division ratios of the resistive divider 12 and hence different values of the voltage-feedback signal $V2_{fb}$.

In detail, when the transistor 40 is turned on (ON phase of the PWM control signal), the third resistor 37 is short-circuited and the resistive divider 12 is formed only by the first resistor 27 and second resistor 28 having resistances $R_1$ and $R_2$, respectively. In this situation, the voltage-feedback signal $V2_{fb}$ assumes a first value $V2_{fb1}$ equal to $$V2_{fb1} = V_{out} \cdot \frac{R_2}{R_2 + R_1}$$

whereas, when the transistor 40 is turned off (OFF phase of the PWM control signal), the resistive divider 12 is formed by the first resistor 27, the second resistor 28, and a third resistor 37, wherein the third resistor 37 has a resistance $R_3$. In this case, the voltage-feedback signal $V2_{fb}$ assumes a second value $V2_{fb2}$ equal to $$V2_{fb2} = V_{out} \cdot \frac{R_2 + R_3}{R_2 + R_3 + R_1}$$

where obviously $V2_{fb2} > V2_{fb1}$.

It follows that, during the ON phase of the PWM control signal, the inverting terminal of the second operational amplifier 30 is at a potential $V2_{fb1}$ smaller than that of the non-inverting terminal receiving the second reference voltage $V_{ref2}$, so that the output of the second operational amplifier 30 becomes positive, causing an off-state of the second diode 34. Instead, the first operational amplifier 21 receives, on its inverting terminal, a voltage $V1_{fb}$ proportional to the current flowing in the sensing resistor 20, greater than the first reference voltage $V_{ref1}$, and hence the first diode 24 is on. In this way, the feedback node 23 is coupled to the first feedback path, and the voltage control is disabled, whereas the current control through the current sensor 11 is enabled. The first reference voltage $V_{ref1}$ has a low value (for example, 100 mV) so as to limit the power dissipation on the sensing resistor 20.

Instead, during the OFF phase of the PWM control signal, the inverting terminal of the second operational amplifier 30 is at a potential $V2_{fb2}$ higher than that of the non-inverting terminal, receiving the second reference voltage $V_{ref2}$, so that the output of the second operational amplifier 30 becomes negative, causing turning-on of the second diode 34. Instead, in this situation, the first diode 24 is turned off. In this way, the feedback node 23 is coupled to the second feedback path, and consequently the voltage control is enabled, which limits the output voltage $V_{out}$ to a value lower than the threshold voltage of the array 6, as described above. The value of the second reference voltage $V_{ref2}$ supplied to the non-inverting terminal of the second operational amplifier 30, and the values of the resistances are chosen so that the output voltage $V_{out}$ assumes the desired value.

The driving device described herein presents the following advantages, although all such as advantages need not be realized by all embodiments of the present disclosure.

First, it has a driving efficiency greater than known driving devices, in so far as it does not have elements arranged in series to the load that generate leakages.

Furthermore, the production costs are decidedly lower, in so far as the need for the presence of a costly power switch is avoided, since the latter is replaced by a simple signal switch, of negligible cost.

Finally, in the case of integration of the driving device, it does not present problems of power dissipation, with consequent savings and greater simplicity of production.

Finally, it is clear that modifications and variations can be made to the device for driving LEDs described and illustrated herein, without thereby departing from the scope of the present disclosure, as defined in the annexed claims.

In particular, it is emphasized that the present driving device, although designed for driving arrays of LEDs of the type described, does not include said light-emitting elements, which consequently do not form part of the driving device.

Figure 4:
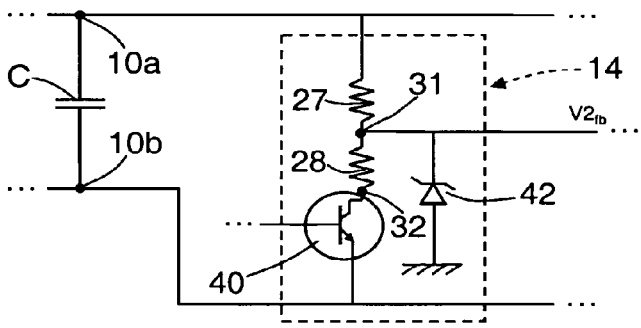
FIG. 4 is a circuit diagram of an enabling stage of the circuit of FIG. 1, according to a further embodiment of the present disclosure.

Furthermore, FIG. 4 shows a further embodiment of the enabling stage 14 of the driving device 1. In particular, the resistive divider of the enabling stage 14 comprises only the first resistor 27 and the second resistor 28, the first resistor 27 being coupled between the first output 10*a* and the first intermediate node 31, and the second resistor 28 being coupled between the first intermediate node 31 and the second intermediate node 32. The bipolar transistor 40 still has its collector terminal coupled to the second intermediate node 32, its emitter terminal coupled to the second output 10*b*, and its base terminal receiving the PWM control signal generated by the PWM control circuit 13. According to this further embodiment, the enabling stage 14 further comprises a zener diode 42, which is coupled between the first intermediate node 31 and ground of the driving device 1.

Operation of the driving device 1 according to this further embodiment is now described, referring to the situation in which the driving device 1 drives an array 6 having a number of LEDs 7 equal to $N_{led}$.

When the transistor 40 is turned on (ON phase of the PWM control signal), the voltage-feedback signal $V2_{fb}$ assumes the first value $V2_{fb1}$:

$$V2_{fb1} = V_{out} \cdot \frac{R_2}{R_2 + R_1}$$

The first value $V2_{fb1}$ is smaller than the second reference voltage $V_{ref2}$, so that the current control through the current sensor 11 is enabled (as previously described). The LEDs 7 are thus in the on-state and the output voltage $V_{out}$ is $N_{led}$@3.5 V (3.5 V being the on-voltage drop of each LED 7 of the array 6).

Instead, during the OFF phase of the PWM control signal, the transistor 40 is turned off, and the voltage-feedback signal $V2_{fb}$ is instantaneously pulled up to a value higher than the second reference voltage $V_{ref2}$ (zener diode 42 can limit this value so that a maximum voltage that can be applied to the second operational amplifier 30 is not exceeded), thus enabling voltage control. Therefore, the output current $I_{out}$ flowing in the LEDs 7 falls to zero, while the output voltage $V_{out}$ decreases down to $N_{led}$@2 V (2 V being the threshold voltage of each LED 7). Further decrease of the output voltage $V_{out}$ is not possible, due to high output impedance.

Capacitor C at the output of the supply stage 9 thus experiences a voltage variation ΔV at the switching between the ON and the OFF phase of the PWM control signal, which is equal to $N_{led}$@1.5V. This voltage variation ΔV causes a delay t in the reactivation of LEDs 7 (due to the charging of capacitor C) of:

$$t = \frac{C}{I_{out}} \cdot \Delta V = \frac{C}{I_{out}} \cdot (1.5 \cdot N_{led})$$

Given a same value of the capacitor C, the delay t in this further embodiment is greatly reduced with respect to the circuit shown in FIG. 3. In fact, in the circuit of FIG. 3 the voltage variation ΔV is:

$$\Delta V = (3.5 \cdot N_{led} - 2)$$

since the output voltage $V_{out}$ is limited to 2 V during the OFF stage of the PWM control signal (irrespective of the number of LEDs 7), and so the delay t is given by:

$$t = \frac{C}{I_{out}} \cdot \Delta V = \frac{C}{I_{out}} \cdot (3.5 \cdot N_{led} - 2)$$

In particular, the advantage in terms of reduction of the delay time t increases with the increase of the number $N_{led}$ of LEDs 7 in the array 6.

The invention claimed is:

1. A device for driving a light-emitting-diode element, with variable light intensity and having a turning-on threshold voltage, the device comprising:

a supply stage having an output to be connected to said light-emitting-diode element, said supply stage being configured so as to have a first operating mode and a second operating mode, wherein, in said first operating mode, said supply stage generates a controlled supply current and, in said second operating mode, said supply stage generates a controlled supply voltage no greater than said turning-on threshold voltage;

a current sensor, connectable to said output for generating, in use, a current-feedback signal correlated to the current flowing in said light-emitting-diode element and sent to said supply stage in said first operating mode; and an intensity-control stage generating a mode-control signal sent to said supply stage and controlling sequential switching between said first and second operating modes of said supply stage according to a desired light intensity.

2. The driving device according to claim 1 for a light-emitting-diode element comprising a plurality of LEDs connected in series and each LED having an own threshold voltage; wherein said turning-on threshold voltage is equal to the sum of said own threshold voltages of said LEDs.

3. The driving device according to claim 1, wherein said mode-control signal is a periodic signal defining a first time interval and a second time interval corresponding to said first and said second operating modes, said intensity-control stage comprising regulation means for regulating said first and second time intervals.

4. The driving device according to claim 3, wherein said regulation means comprise a pulse-width modulator—PWM.

5. The driving device according to claim 3, wherein said intensity-control stage further comprises an enabling stage connected between said regulation means and said supply stage and generating said mode-control signal.

6. The driving device according to claim 5, wherein said enabling stage comprises a voltage divider having a first intermediate node supplying said mode-control signal and means for modifying the dividing ratio, controlled by said regulation means.

7. The driving device according to claim 6, wherein said supply stage comprises a regulator and a selection stage, said regulator having a feedback input and said selection stage receiving said mode-control signal and said current-feedback signal and supplying to said feedback input alternately said current-feedback signal in said first operating mode and said mode-control signal in said second operating mode.

8. The driving device according to claim 7, wherein said selection stage comprises a comparison circuit receiving said current-feedback signal, said mode-control signal and a reference signal and feeding said feedback input with said current-feedback signal in presence of a first relation between said mode-control signal and said reference signal, and said mode-control signal in presence of a second relation between said mode-control signal and said reference signal.

9. The driving device according to claim 8, wherein said comparison circuit comprises operational-amplifier means having a first terminal receiving said mode-control signal, a second terminal receiving said reference voltage, and an output connected to said feedback input via unidirectional means.

10. The driving device according to claim 9, wherein said unidirectional means comprise a diode having its cathode connected to said feedback input and its anode connected to the output of said operational-amplifier means.

11. A method for driving a light-emitting-diode element with variable light intensity, comprising the steps of:

supplying said light-emitting-diode element with a controlled supply current in a first operating mode;

supplying said light-emitting-diode element with a controlled supply voltage in a second operating mode, said controlled supply voltage being no greater than a turning-on threshold voltage of said light-emitting-diode element; and controlling alternately a sequential switching between said first and second operating modes.

12. The method according to claim 11, wherein said step of controlling alternately comprises the step of generating a periodic mode-control signal, defining a first time interval and a second time interval corresponding to said first operating mode and said second operating mode, respectively, the method further comprising the step of regulating the duration of said first time interval and said second time interval.

13. The method according to claim 12, wherein said step of regulating comprises generating a pulse-width-modulated control signal.

14. The method according to claim 12, wherein said mode-control signal is proportional to an output voltage across said light-emitting-diode element; and said step of controlling alternately comprises varying the ratio of proportionality between said mode-control signal and said output voltage, comparing said mode-control signal with a reference signal, and enabling alternately said first and second operating modes according to the result of said comparison.

15. A circuit for driving a light-emitting-diode component, the light-emitting-diode component having a turn-on threshold voltage and the circuit comprising:

a supply stage circuit having an output adapted to be coupled the light-emitting-diode component and operable in a current control mode and a voltage control mode responsive to a mode control signal, the supply stage circuit operable in the current control mode responsive to the mode control signal being active to supply a current to the light emitting-diode component, with the current having a value that is a function of current feedback signal, and the supply stage circuit operable in the voltage control mode responsive to the mode control signal being inactive to apply a voltage to the light emitting-diode component, the voltage having a value that is no greater than the turn-on threshold voltage;

a current sensor coupled to the supply stage circuit and adapted to be coupled to the light emitting-diode component, the current sensor operable to generate the current feedback signal having a value that is a function of the current flowing through the light-emitting-diode component in the current-control mode of operation; and an intensity control circuit coupled to the supply stage circuit and adapted to receive an intensity signal, the intensity control circuit operable to develop the mode control signal responsive to the intensity signal and the intensity-control circuit alternately activating and deactivating the mode control signal as a function of the intensity signal to control an intensity of light generated by the light-emitting-diode component.

16. The circuit of claim 15, wherein the mode control signal is a periodic signal defining a first time interval during which the supply stage circuit operates in the current control mode and a second time interval during which the supply stage operates in the voltage control mode.

17. The circuit of claim 15, wherein the supply stage circuit comprises a DC-to-DC converter.

18. An electronic system, comprising:

an electronic subsystem including, a light-emitting-diode component having a turn-on threshold voltage; and a driver circuit coupled to the light-emitting-diode component, the driver circuit including, a supply stage circuit having an output adapted to be coupled the light-emitting-diode component and operable in a current control mode and a voltage control mode responsive to a mode control signal, the supply stage circuit operable in the current control mode responsive to the mode control signal being active to supply a current to the light emitting-diode component, with the current having a value that is a function of current feedback signal, and the supply stage circuit operable in the voltage control mode responsive to the mode control signal being inactive to apply a voltage to the light emitting-diode component, the voltage having value that is no greater than the turn-on threshold voltage;

a current sensor coupled to the supply stage circuit and adapted to be coupled to the light emitting-diode component, the current sensor operable to generate the current feedback signal having a value that is a function of the current flowing through the light-emitting-diode component in the current-control mode of operation; and an intensity control circuit coupled to the supply stage circuit and adapted to receive an intensity signal, the intensity control circuit operable to the develop the mode control signal responsive to the intensity signal and the intensity-control circuit alternately activating and deactivating the mode control signal as a function of the intensity signal to control an intensity of light generated by the light-emitting-diode component.

19. The electronic system of claim 18, wherein the electronic subsystem comprises an automotive subsystem and the light-emitting-diode component corresponds to a rear light contained in the automotive subsystem.

20. The electronic system of claim 18, wherein the electronic subsystem comprises a road sign subsystem and the light-emitting-diode component corresponds to a light contained in the road sign subsystem.

21. The electronic system of claim 18, wherein the electronic subsystem comprises a traffic light subsystem and the light-emitting-diode component corresponds to a light contained in the traffic light subsystem.

* * * * *